US007553170B2

(12) United States Patent
Minich

(10) Patent No.: US 7,553,170 B2
(45) Date of Patent: Jun. 30, 2009

(54) SURFACE MOUNT CONNECTORS

(75) Inventor: Steven E. Minich, York, PA (US)

(73) Assignee: FCI Americas Technology, Inc., Carson City, NV (US)

( * ) Notice: Subject to any disclaimer, the term of this patent is extended or adjusted under 35 U.S.C. 154(b) by 0 days.

(21) Appl. No.: 11/641,165

(22) Filed: Dec. 19, 2006

(65) Prior Publication Data

US 2008/0146053 A1 Jun. 19, 2008

(51) Int. Cl.
*H01R 1/00* (2006.01)

(52) U.S. Cl. ..... 439/83

(58) Field of Classification Search ..... 439/79, 439/701, 83

See application file for complete search history.

(56) References Cited

U.S. PATENT DOCUMENTS

| | | | | |
|---|---|---|---|---|
| 4,616,893 | A | 10/1986 | Feldman et al. | |
| 5,102,352 | A | 4/1992 | Arisaka | 439/608 |
| 5,255,839 | A | 10/1993 | Da Costa Alves et al. | 228/180.21 |
| 5,519,580 | A | 5/1996 | Natarajan et al. | 361/760 |
| 5,527,189 | A | 6/1996 | Middlehurst et al. | 439/608 |
| 5,538,433 | A | 7/1996 | Arisaka | 439/70 |
| 5,562,462 | A | 10/1996 | Matsuba et al. | 439/70 |
| 5,702,255 | A | 12/1997 | Murphy et al. | 439/71 |
| 5,746,608 | A | 5/1998 | Taylor | 439/70 |
| 5,904,581 | A | 5/1999 | Pope et al. | |
| 6,007,348 | A | 12/1999 | Murphy | 439/70 |
| 6,007,366 | A | 12/1999 | Torii et al. | |
| 6,241,535 | B1 | 6/2001 | Lemke et al. | 439/83 |
| 6,325,280 | B1 | 12/2001 | Murphy | 228/246 |
| 6,325,644 | B1 | 12/2001 | Lemke et al. | |
| 6,371,773 | B1 * | 4/2002 | Crofoot et al. | 439/79 |
| 6,426,564 | B1 | 7/2002 | Ball | 257/783 |
| 6,498,390 | B1 | 12/2002 | Barrow | 257/675 |
| 6,527,597 | B1 | 3/2003 | Harper, Jr. | 439/701 |
| 6,530,788 | B1 | 3/2003 | Ju | 439/83 |
| 6,544,046 | B1 | 4/2003 | Hahn et al. | 439/83 |
| 6,572,397 | B2 | 6/2003 | Ju | 439/342 |
| 6,638,082 | B2 | 10/2003 | Belopolsky et al. | 439/83 |
| 6,652,318 | B1 * | 11/2003 | Winings et al. | 439/608 |
| 6,666,693 | B2 | 12/2003 | Belopolsky et al. | 439/79 |
| 6,712,626 | B2 * | 3/2004 | Harper et al. | 439/83 |
| 6,830,462 | B1 | 12/2004 | Harper, Jr. | 439/71 |
| 6,855,623 | B2 | 2/2005 | Ball | 438/612 |
| 6,899,550 | B2 * | 5/2005 | Perugini et al. | 439/74 |
| 6,971,885 | B2 | 12/2005 | Mowry | 439/66 |
| 7,021,945 | B2 * | 4/2006 | Perugini et al. | 439/74 |
| 7,037,138 | B2 * | 5/2006 | Lang et al. | 439/608 |
| 7,226,296 | B2 * | 6/2007 | Ngo | 439/71 |
| 7,226,298 | B1 * | 6/2007 | Minich | 439/83 |
| 7,258,551 | B2 * | 8/2007 | Minich | 439/67 |
| 7,300,317 | B2 * | 11/2007 | Dillon et al. | 439/678 |
| 2004/0048504 | A1 | 3/2004 | Hynes et al. | 439/83 |

(Continued)

FOREIGN PATENT DOCUMENTS

WO WO 2006031296 A2 3/2006

*Primary Examiner*—Neil Abrams
*Assistant Examiner*—Phuong Nguyen
(74) *Attorney, Agent, or Firm*—Woodcock Washburn LLP

(57) ABSTRACT

A surface mount electrical connector is disclosed. Such an electrical connector may include a connector housing and a leadframe assembly received into the connector housing. he connector housing may define a first planar surface, and have a first rigidity. The leadframe assembly may have a second rigidity that is greater than the first rigidity. Thus, the leadframe assembly may cause the first surface to remain planar at a solder reflow temperature.

28 Claims, 10 Drawing Sheets

U.S. PATENT DOCUMENTS

2005/0009385 A1 1/2005 Korsunsky et al. ..... 439/83
2006/0016071 A1 1/2006 Huang ..... 29/852
2006/0065972 A1 3/2006 Khan et al. ..... 257/712
2007/0026743 A1* 2/2007 Minich ..... 439/701

* cited by examiner

SURFACE MOUNT CONNECTORS

BACKGROUND

An issue in circuit board manufacture is the effect of the soldering process on the electrical components due to the heat required to melt solder. For example, electrical connectors often employ housings that are made of a material having a coefficient of thermal expansion that is different from that of the printed circuit board (PCB). As a result, the connector housing tends to warp under the heat required for solder reflow.

Typically, it is desirable for the connector housing to remain flat during the product life cycle. For example, in ball grid array (BGA) connectors, warping along the plane of the mounting end tends to decrease the coplanarity of the BGA. This may cause a misalignment between the BGA and the conductive contact pads of the circuit board or open circuits after reflow. Also, warping along the walls of the connector may cause a misalignment with mating connectors. As a result, greater peak insertion force may be required to mate the connectors, and more force may be required to decouple the connectors as well.

Thus, there is a need for an electrical connector that resists housing warp, increases BGA coplanarity, and maintains appropriate insertion forces even after being subject to reflow temperatures.

SUMMARY

An electrical connector in accordance with the invention may include one or more insert molded leadframe arrays (IMLAs) and a connector housing. The connector housing may define a mating portion and a mounting frame. The mounting frame may include a bottom mounting side, a top mating side, and one or more receiving slots extending from the bottom mounting side to the top mating side. Each receiving slot may be adapted to receive a respective IMLA. The mating portion of the connector housing may be connected to the top mating side of the mounting frame and may be suitable for establishing a mechanical connection to a complementary connector.

The IMLA may have a rigid leadframe housing made of a dielectric material. The IMLA may be adapted for being secured by a receiving slot. The IMLA may be retained in receiving slot via an interference fit. In addition, the IMLA may include a plurality of electrically conductive contacts suitable for surface mounting to a substrate by reflow soldering, such as a ball grid array, for example. The fusible mounting elements are co-planar at the solder reflow temperature and at an ambient temperature. The IMLA may be a "blank," i.e., without contacts.

The mounting frame may be designed to be less rigid than the one or more IMLAs retained in the one or more receiving slots. To accomplish this, the mounting frame may be made of less rigid material than the insert body. The mounting frame may include areas of reduced rigidity to make the overall rigidity of the mounting frame less than that of the one or more IMLAs. Areas of reduced rigidity can include voids within the mounting frame that are open to a surface of the mounting frame, and areas of the mounting frame that are thinner than other areas of the mounting frame.

Where the mounting frame is less rigid than the IMLAs, the rigidity of the IMLAs supports the mounting frame, and thus enables the housing to resist warping, when the assembled connector is heated to soldering temperatures. Though the heat would otherwise deform the less rigid mounting frame, each IMLA presses along the receiving slot to maintain the form of the mounting frame and, in turn, the connector housing as a whole, to within acceptable tolerances.

BRIEF DESCRIPTION OF THE DRAWINGS

FIGS. 3A and 3B are isometric views, and FIG. 3C is a side view.

DETAILED DESCRIPTION

Figure 1A:
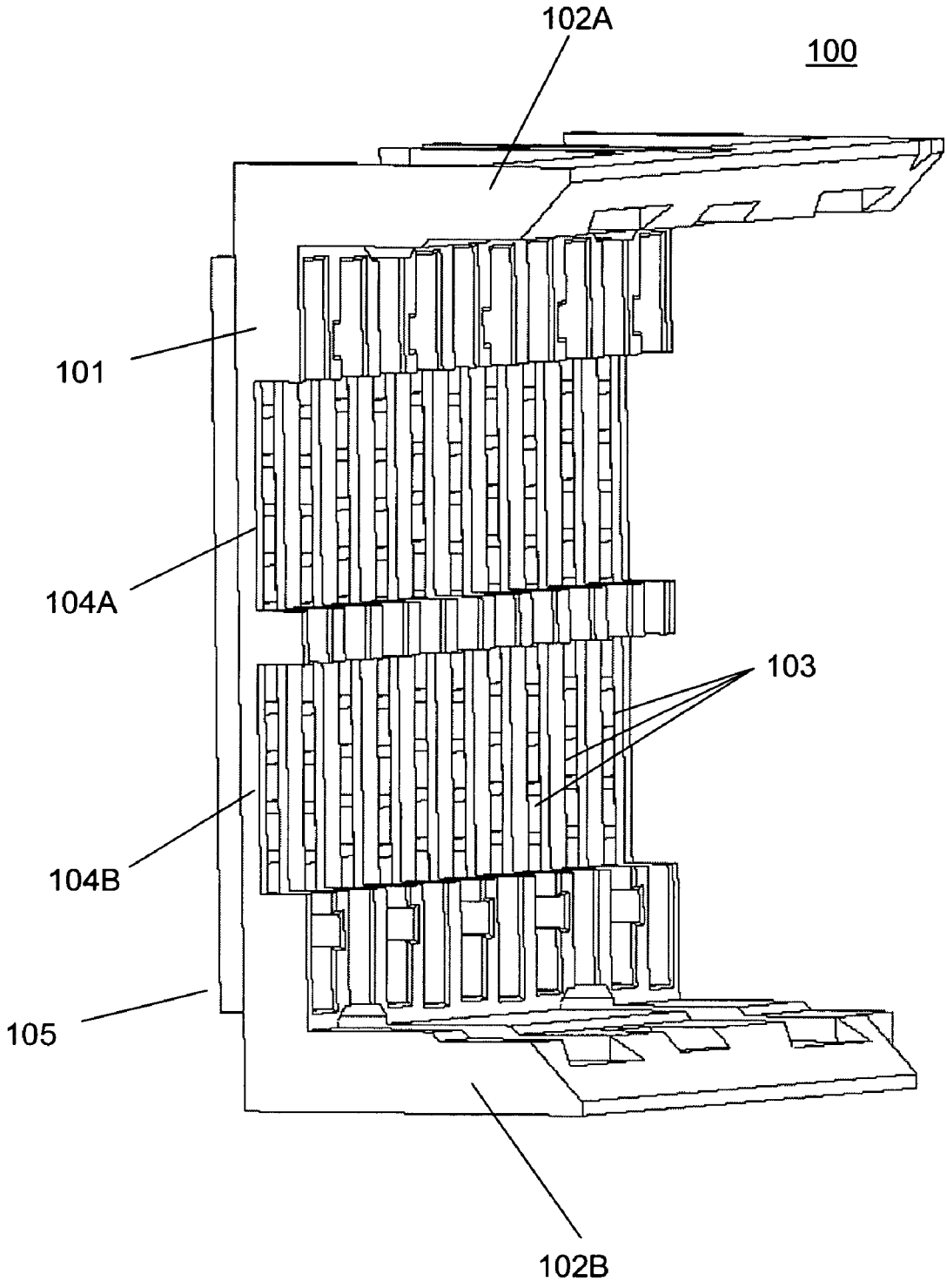
FIGS. 1A and 1B depict an illustrative connector housing, in isometric and side views respectively.
Figure 1B:
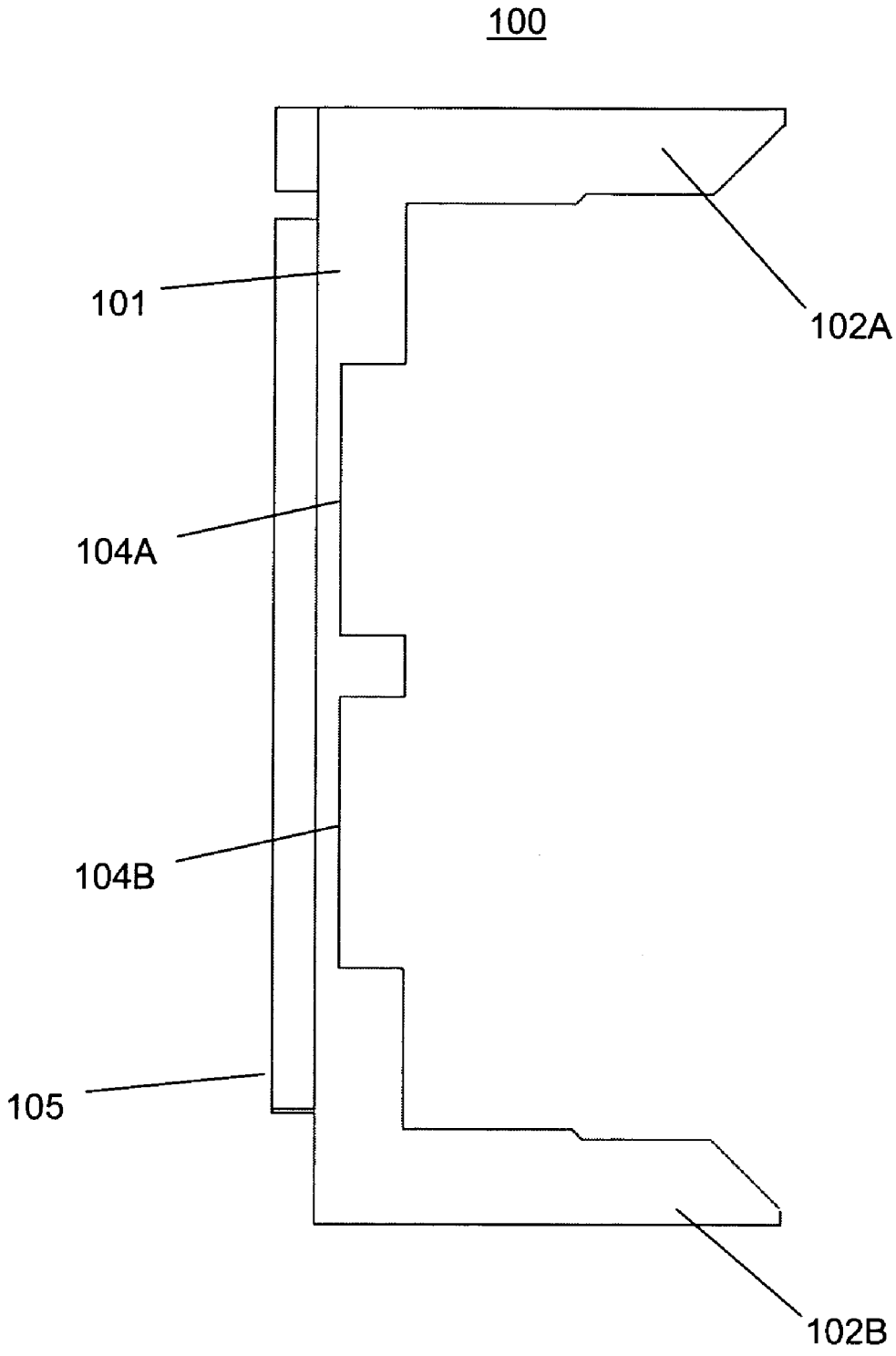

FIGS. 1A and 1B depict an illustrative connector housing 100, in isometric and side views respectively. The connector housing 100 may include a mounting frame 101 connected to a mating portion 102A-B. The connector housing 100 may be made of plastic. For example, the connector housing 100 may be made of high temperature thermoplastic, UL 94V-0 compliant material, or the like. The connector housing 100 may be manufactured by any technique such as injection molding, for example.

The mating portion 102A-B may be connected to a top side of the mounting frame 101. The mating portion 102A-B may be configured for coupling the connector housing 100 with a complementary connector (not shown). For example, the mating portion 102A-B may include notches, latches, guide ramps, and the like to establish a mechanical connection with a complementary connector.

The mounting frame 101 may include a mounting surface 105. When mounting the connector housing 100 to a substrate, such as a printed circuit board, for example, the mounting surface 105 may abut a surface of the substrate.

One or more receiving slots 103 may extend through the mounting frame 105 from the mounting side thereof to the top side thereof. Each receiving slot 103 may be adapted to retain a respective IMLA (not shown). The receiving slots 103 may be aligned parallel to each other and to the sides of the connector housing 100. The slots 103 may extend along the mounting frame 105 between the first mating portion 102A and the second mating portion 102B.

The mounting frame may include one or more areas of reduced rigidity, such as notches 104A-B. The notches 104A-B may be areas of the mounting frame 101 that are thinner than surrounding areas of the mounting frame 101. The notches 104A-B may extend across the mounting frame 101, intersecting the tops of the receiving slots 103. In another embodiment, areas of reduced rigidity may include voids (not shown) within the mounting frame that are open to a surface of the mounting frame.

Figure 2A:
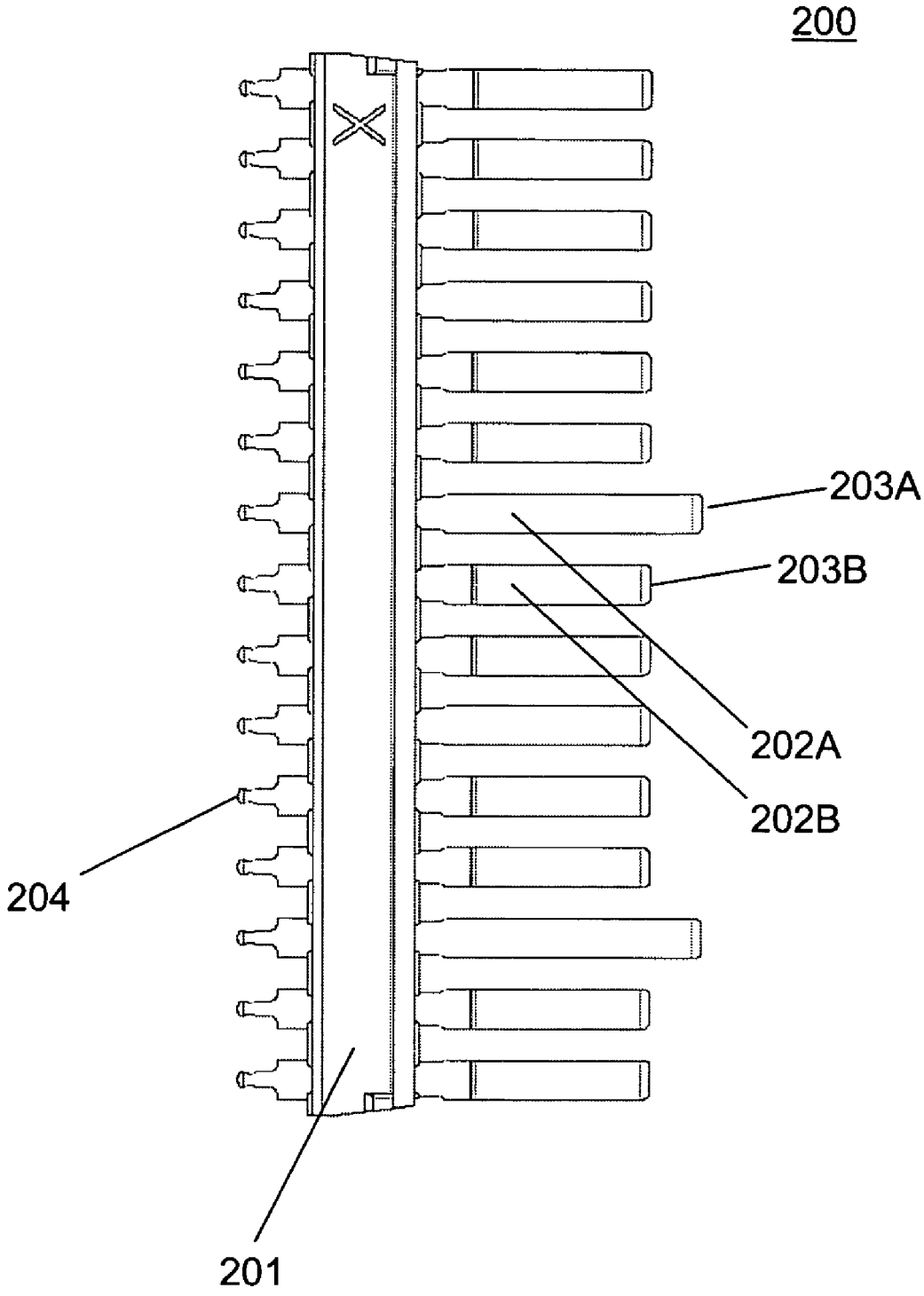
FIGS. 2A, 2B, and 2C depict an illustrative IMLA with male electrically conductive contacts, in side, end, and isometric views respectively.
Figure 2B:
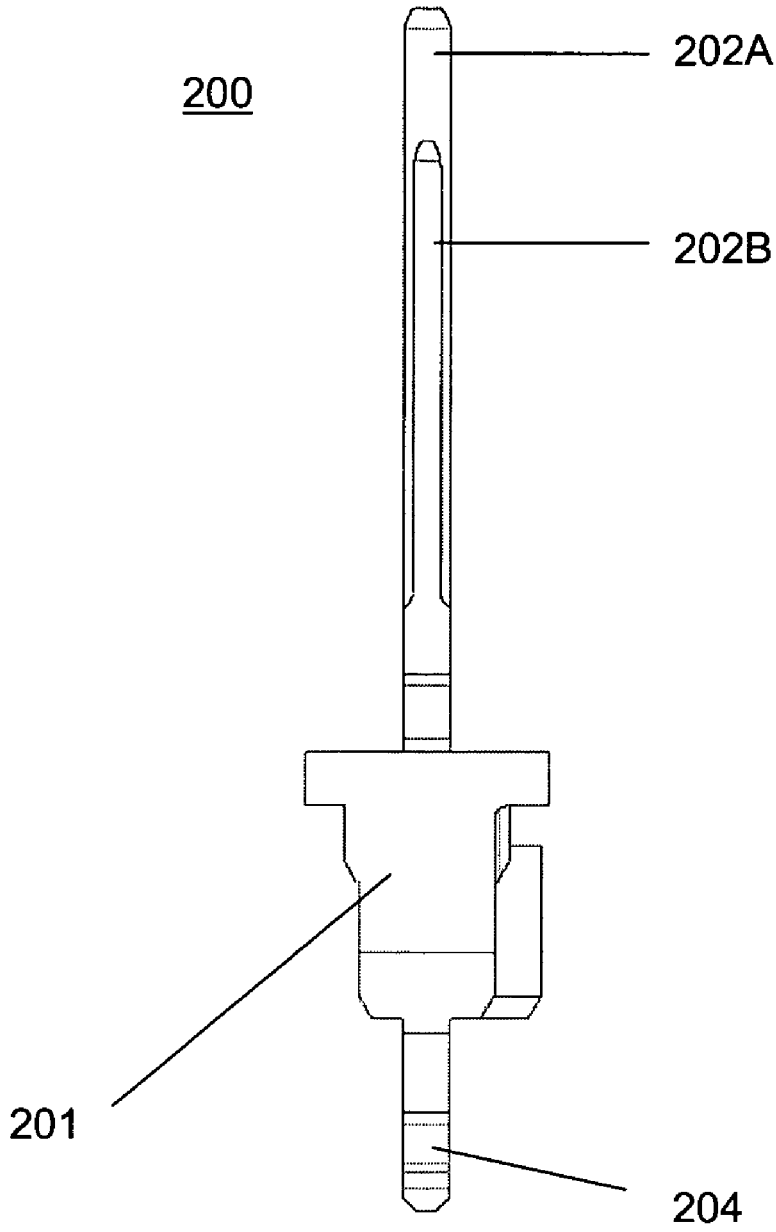
Figure 2C:
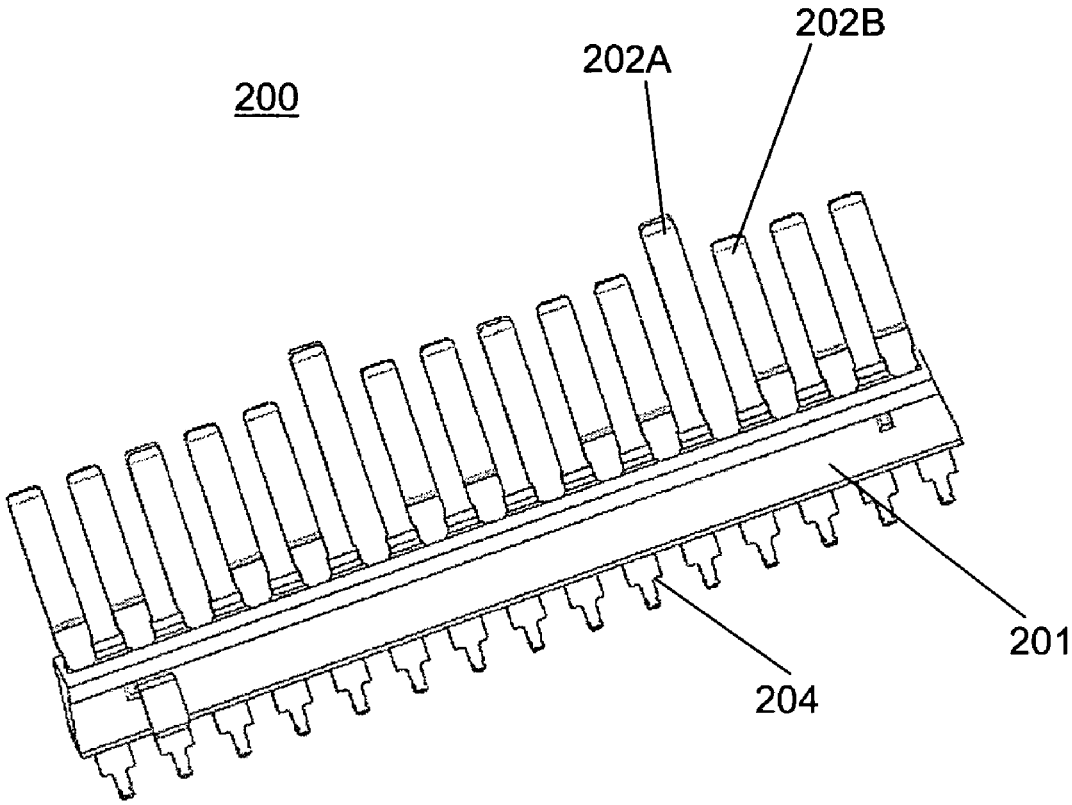

FIGS. 2A-C depict an illustrative IMLA 200 with male, electrically-conductive contacts. The IMLA 200 may include a dielectric leadframe housing 201. Electrically conductive contacts 202A-B may extend through the leadframe housing 201. Manufacturing the IMLA 200 may include stamping the contacts 202A-B from a conductive material and molding the leadframe housing 201 onto the contacts 202A-B. The IMLA 200 may include any desired number of contacts 202A-B. Each contact 202A-B may have a respective mounting end 204. The mounting ends 204 may be adapted for connecting the IMLA 200 to a substrate, such as a printed circuit board, for example. The mounting ends 204 may be suitable for solder ball mounting to a printed circuit board, for example. Each contact may terminate with a fusible mounting element, such as a solder ball, for example.

An IMLA 200 may be used for single-ended signaling, differential signaling, or a combination of single-ended signaling and differential signaling. Each contact 204 may be selectively designated as a ground contact 202A or a signal contact 202B. The signal contact 202B may be a single-ended signal conductor or one of a differential signal pair of signal conductors.

Each contact 202A-B may include a respective mating end 203A-B. The mating ends 203A-B may each be configured to engage an complementary mating end (not shown) of another connector. For example, the mating end 203A-B may be configured as a blade (male) contact, or as a receptacle (female) contact. The ground contacts 202A may include a mating end 203A which may extend beyond the mating ends of the other contacts. Thus, the ground contacts 202A may mate with complementary contacts before any of the signal contacts mates.

Figure 3A:
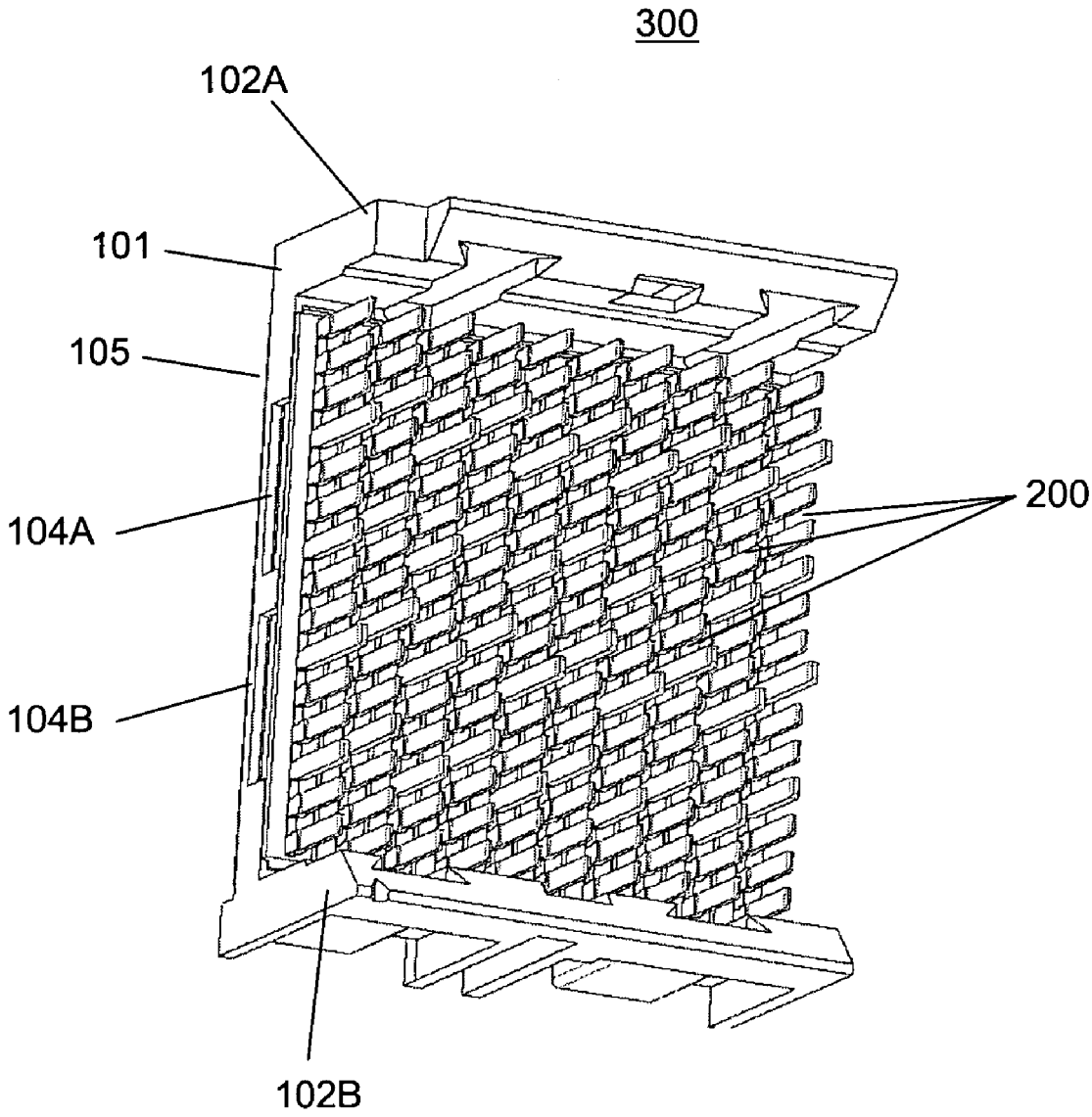
FIGS. 3A, 3B, and 3C depict an illustrative plug connector without solder balls.
Figure 3B:
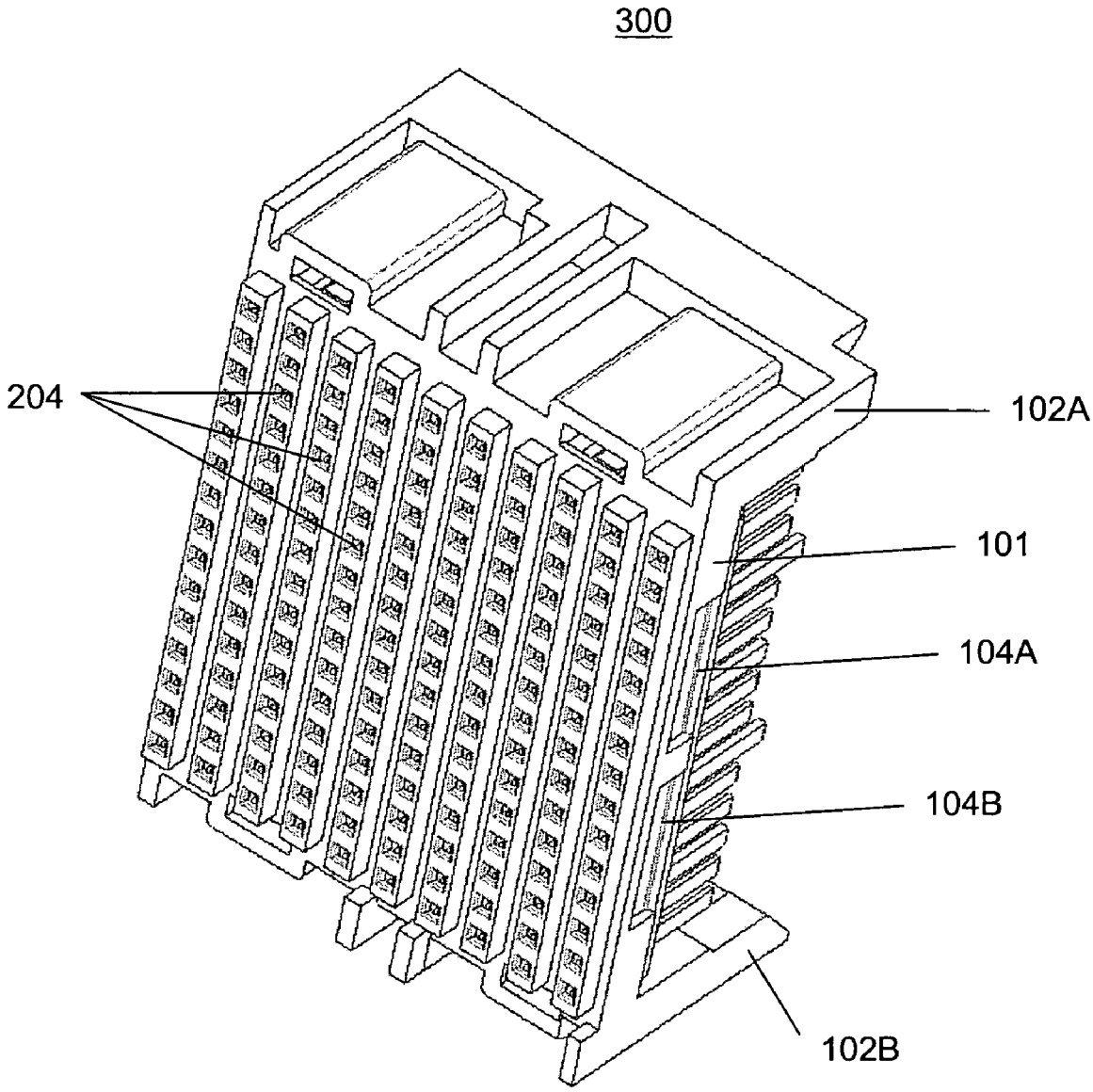
Figure 3C:
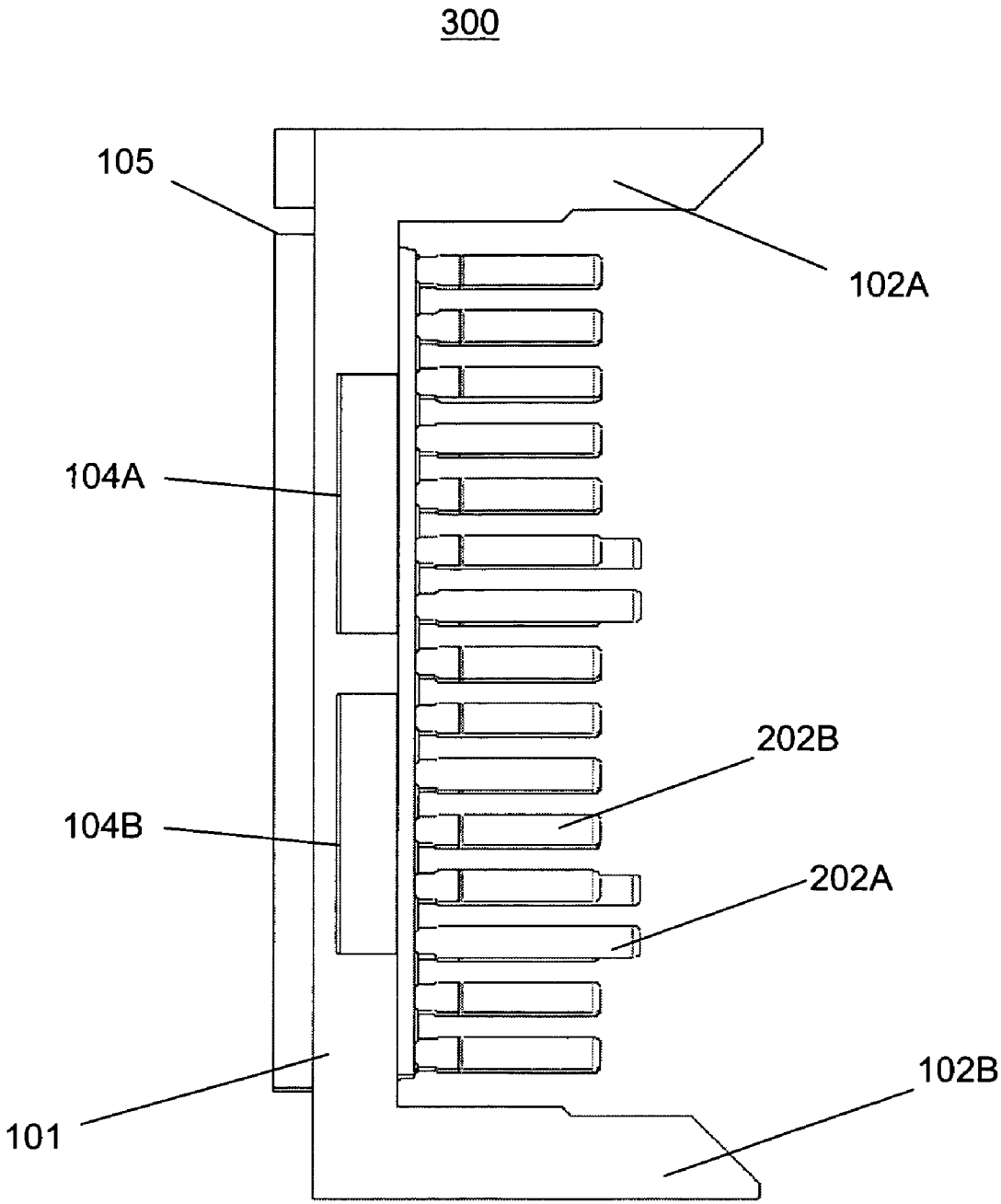

FIGS. 3A-C depict an illustrative connector 300, without solder balls. As shown, the connector 300 may include a connector housing 101 and one or more IMLAs 200. Each receiving slot 103 of the connector housing 101 may receive a respective IMLA 200. Each IMLA 200 may be interference fit into each respective receiving slot 103. Once received in the connector housing 101, the mounting ends 204 of the contacts may define a plane.

The connector housing 101 may include areas of reduced rigidity, such as notches 104A-B in the mounting frame 101. The areas of reduced rigidity may ensure that the collective rigidity of the received IMLAs 200 is greater than that of the connector housing 101. As a result, when the connector 300 is soldered onto a printed circuit board by a reflow process, the rigidity of the IMLAs 200 will enable the housing 101 to resist thermal warping. Due to their rigidity, the IMLAs 200 may remain planar on the mounting surface 105. Similarly, the mounting ends 204 of the contacts may continue to define a plane. The reduced thermal warping of the connector housing may enables the mating portion 102A-B of the connector housing 101 to maintain its integrity, which may improve the ease of joining and separating the connector 300 with a complementary connector (not shown). The improvement may be apparent in lowered peak insertion force when joining the connectors.

A blank IMLA may provide the desired rigidity, just as would a populated IMLA 200. A blank IMLA may be used in applications where the number of receiving slots 103 in the connector housing 101 exceeds that required of the electrical design. Rather than leaving these extra receiving slots 103 empty, each may receive a blank IMLA.

Figure 4A:
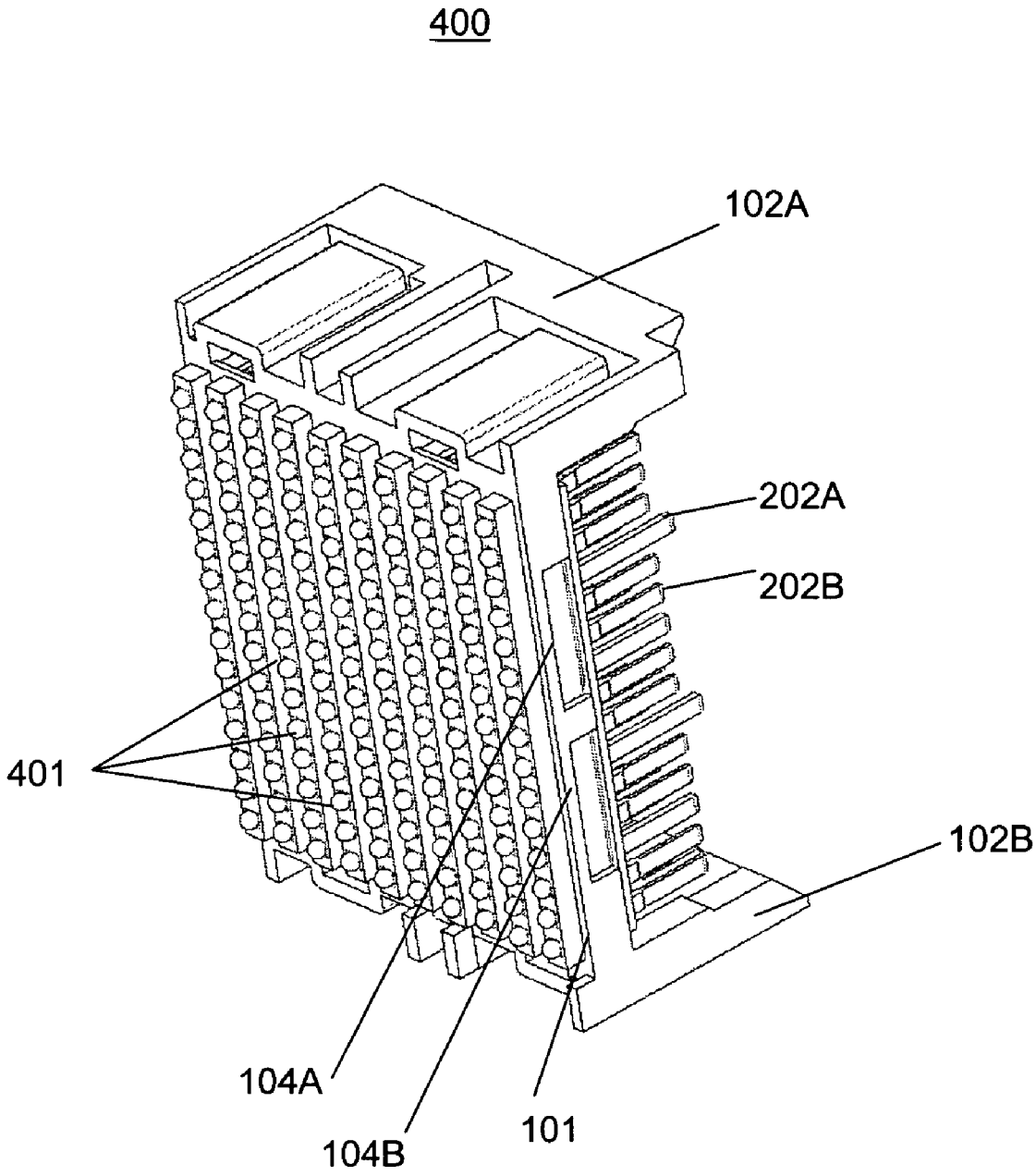
FIGS. 4A and 4B depict an illustrative plug connector with solder balls, in isometric and side views respectively.
Figure 4B:
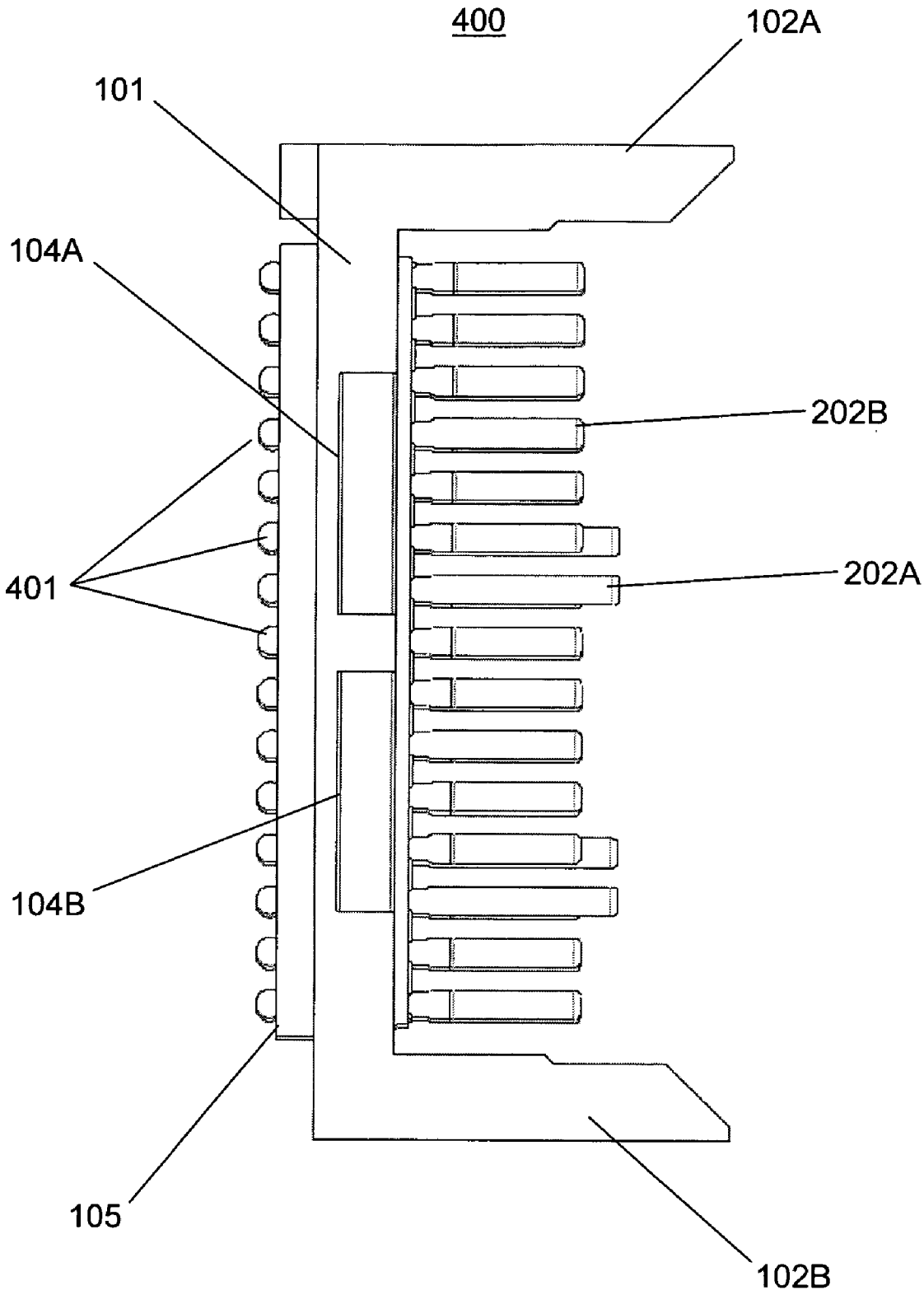

FIGS. 4A and 4B depict an illustrative connector 400 with a grid array of solder balls 401. As shown, the mounting end 204 of each contact may include a solder ball 401. The solder balls 401 collectively may define a plane.

The solder balls 401 enable the connector 400 to be soldered to a printed circuit board. The connector 400 may be placed on a circuit board in a manufacturing process such that the mounting ends 204 of the contacts are positioned above respective solder pads on the circuit board. The combined connector/circuit board assembly may be heated to solder reflow temperatures.

During the reflow process, the rigidity of the IMLAs 200 may enable the connector housing 101 to resist thermal warping. Due to the rigidity of the IMLAs 200, the planarity of the mounting surface 105 and the planarity of the mounting ends 204 of the contacts may be maintained. Also, the reduced thermal warping of the connector housing may improve the integrity of the mating portion 102A-B of the connector housing 101, which may improve the ease of mating and unmating the connector 300 with a complementary connector. The improvement may be apparent in lowered peak insertion force when mating the connectors.

What is claimed:

1. An electrical connector comprising:

a connector housing that defines a mounting frame that defines a slot, and further defines a mounting frame surface and an area of reduced rigidity; and a leadframe assembly configured to be disposed in the slot, wherein the leadframe assembly has a rigidity greater than that of the mounting frame such that the leadframe assembly increases the rigidity of the connector housing when the leadframe assembly is disposed in the slot, such that the mounting frame surface deforms less when the leadframe assembly is disposed in the slot and the mounting frame and leadframe assembly in combination are subjected to a solder reflow temperature relative to deformation of the mounting frame surface when the mounting frame alone is subjected to the solder reflow temperature.

2. The connector of claim 1, wherein the connector housing defines a plurality of receiving slots, the connector farther comprising a plurality of leadframe assemblies, wherein the plurality of leadframe assemblies taken collectively is more rigid than the connector housing.

3. The connector of claim 1, wherein the surface is a mounting face defined by the connector housing at a first end thereof for mounting the connector to a substrate.

4. The connector of claim 1, wherein the surface is a mating face defined by the connector housing at a second end thereof for mating the connector with a complementary connector.

5. The connector of claim 1, wherein the leadframe assembly is interference fit into the receiving slot.

6. The connector of claim 1, further comprising a second leadframe assembly that is blank and is interference fit into the connector housing.

7. The connector of claim 1, wherein the area of reduced rigidity is disposed at a wall of the mounting frame.

8. The connector of claim 1, wherein the area of reduced rigidity includes a void within the mounting frame.

9. The connector of claim 1, wherein the area of reduced rigidity comprises a notch in the mounting frame.

10. The connector of claim 1, wherein the connector housing is made of a first material, the leadframe assembly has a leadframe assembly housing that is made of a second material, and the second material is more rigid than the first material.

11. The electrical connector of claim 1, wherein the surface is planar prior to being subjected to the solder reflow temperature, and the surface remains planar being subjected to the solder reflow temperature when the leadframe assembly is disposed in the slot.

12. The connector of claim 1, wherein the leadframe assembly comprises an array of electrical contacts.

13. The connector of claim 12, wherein each of the electrical contacts terminates with a fusible mounting element and the fusible mounting elements are co-planar at a solder reflow temperature and at an ambient temperature.

14. A housing for an electrical connector, the housing comprising:

a mounting frame that defines a bottom surface, a top surface opposite the bottom surface, and a slot extending through the mounting frame from the bottom surface to the top surface, the slot being adapted to receive a leadframe assembly; and a mating portion, connected to the top mating surface, for mating with a complementary electrical connector, wherein the mounting frame defines an area of reduced rigidity such that the mounting frame has an overall rigidity that causes the bottom surface to deform when the mounting frame is subjected to a solder reflow temperature when the leadframe assembly is not disposed in the slot, and the leadframe assembly has a rigidity such that the bottom surface deforms less when the leadframe assembly is disposed in the slot when the housing is subjected to the solder reflow temperature.

15. The housing of claim 14, wherein the area of reduced rigidity is disposed at a wall of the mounting frame.

16. The housing of claim 14, wherein the area of reduced rigidity includes a void disposed in the mounting frame.

17. The housing of claim 14, wherein the area of reduced rigidity includes a notch disposed in the mounting frame.

18. The housing of claim 14, wherein the housing is made of a first material, the leadframe assembly has a leadframe assembly housing that is made of a second material, and the second material is more rigid than the first material.

19. The housing as recited in claim 14, wherein the bottom surface is planar before the housing is subjected to the solder reflow temperature, and the bottom surface remains planar when the leadframe assembly is disposed in the slot and the housing is subjected to the solder reflow temperature.

20. An electrical connector, comprising:

a connector housing, the connector housing comprising, a housing body that defines a planar mounting face at a first distal end thereof, a mating face at a second distal end thereof, and a plurality of receiving slots extending through the housing body from the mounting face to the mating face, the mounting face being adapted for mounting the electrical connector to a substrate, the mating face being adapted for mating the electrical connector with a complementary electrical connector, wherein the housing body defines an area of reduced rigidity so as to at least partially define an overall rigidity of the housing body; and a plurality of insert molded leadframe assemblies, wherein each leadframe assembly is interference fit within a respective one of the plurality of receiving slots, the plurality of leadframe assemblies having a collective rigidity that is greater than the overall rigidity of the housing body, such that, the collective rigidity of the plurality of leadframe assemblies causes the mounting face to remain planar when subjected to a solder reflow temperature.

21. The electrical connector of claim 20, wherein the connector housing further comprises first and second mating portions extending parallel to one another from the mating face of the housing body, wherein the leadframe assemblies are contained between the first and second mating portions.

22. The electrical connector of claim 21, wherein each of the mating portions has a respective rigidity, the collective rigidity of the leadframe assemblies is greater than the rigidity of each of the mating portions, and the collective rigidity of the plurality of leadframe assemblies causes the mounting face to remain planar by preventing the mating portions from angling toward the mating face of the housing body.

23. An electrical connector comprising:

a dielectric mounting frame having a surface and defining an attachment location, wherein the mounting frame surface deforms when the mounting frame alone is subjected to a solder reflow temperature; and a leadframe assembly including a dielectric leadframe housing and a plurality of electrically-conductive contacts extending through the leadframe housing, wherein the surface deforms less when the leadframe assembly is attached to the mounting frame at the attachment location and the mounting frame and leadframe assembly in combination are subjected to the solder reflow temperature relative to the deformation of the mounting frame surface when the mounting frame alone is subjected to the solder reflow temperature.

24. The electrical connector of claim 23, wherein the mounting frame defines a notch.

25. The electrical connector of claim 23, wherein the surface is a mounting face defined by the mounting frame at a first end thereof for mounting the connector to a substrate.

26. The electrical connector of claim 23, wherein the surface is a mating face defined by the connector housing at a second end thereof for mating the connector with a complementary connector.

27. The electrical connector of claim 23, wherein the surface is a planar surface and the planarity of the planar surface is maintained when the leadframe assembly is received into the receiving slot and the mounting frame and leadframe assembly in combination are subjected to the solder reflow temperature.

28. An electrical connector, comprising:

a connector housing, the connector housing including a housing body that defines a mounting face at a first end thereof, a mating face at a second end thereof, and a plurality of slots extending through the housing body from the mounting face to the mating face, the mounting face being adapted for mounting the electrical connector to a substrate, the mating face being adapted for mating the electrical connector with a complementary electrical connector, wherein the mounting face deforms when the connector housing alone is subjected to a solder reflow temperature; and a plurality of insert molded leadframe assemblies adapted to be disposed within respective ones of the plurality of receiving slots, wherein the mounting face deforms less when the plurality of insert molded leadframe assemblies are disposed in the respective receiving slots and the plurality of insert molded leadframe assemblies and connector housing in combination are subjected to the solder reflow temperature than when the mounting face alone is subjected to the solder reflow temperature.

* * * * *